US011076218B2

(12) United States Patent
Liu

(10) Patent No.: US 11,076,218 B2
(45) Date of Patent: Jul. 27, 2021

(54) HORN ASSEMBLY AND DUAL-LISTENING BLUETOOTH HEADSET

(71) Applicant: SHENZHEN ALEX TECHNOLOGY CO., LTD, Shenzhen (CN)

(72) Inventor: Qingquan Liu, Shenzhen (CN)

(73) Assignee: SHENZHEN ALEX TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/035,778

(22) Filed: Sep. 29, 2020

(65) Prior Publication Data

US 2021/0136480 A1 May 6, 2021

(30) Foreign Application Priority Data

Oct. 31, 2019 (CN) ..... 201921859079.8

(51) Int. Cl.
*H04R 1/10* (2006.01)
*H04R 1/30* (2006.01)

(52) U.S. Cl.
CPC ..... *H04R 1/1075* (2013.01); *H04R 1/1008* (2013.01); *H04R 1/1025* (2013.01); *H04R 1/1041* (2013.01); *H04R 1/30* (2013.01); *H04R 2420/07* (2013.01)

(58) Field of Classification Search
CPC .. H04R 1/1075; H04R 1/1008; H04R 1/1025; H04R 1/1041; H04R 1/30
See application file for complete search history.

(56) References Cited

U.S. PATENT DOCUMENTS

| | | | | |
|---|---|---|---|---|
| 4,924,962 | A * | 5/1990 | Terai | H04R 1/2857 181/141 |
| 2017/0048364 | A1* | 2/2017 | Park | H04R 1/025 |
| 2017/0280230 | A1* | 9/2017 | Kim | H04R 1/1066 |
| 2017/0360614 | A1* | 12/2017 | Ely | H04R 1/1041 |
| 2019/0289388 | A1* | 9/2019 | Lee | H04R 1/1075 |

FOREIGN PATENT DOCUMENTS

| | | | |
|---|---|---|---|
| CN | 209692996 U | * | 11/2019 |
| CN | 209949380 U | * | 1/2020 |

* cited by examiner

*Primary Examiner* — Simon King

(57) ABSTRACT

The present disclosure provides a horn assembly and a dual-listening Bluetooth headset. The horn assembly comprising a housing and a horn. The dual-listening Bluetooth headset includes a horn assembly, the sound outlet of the horn assembly does not need to be inserted into the ear canal, but only needs to be hung on the outer ear. It is more comfortable to wear and submit. The sound from the horn assembly is transmitted along the air through the sound outlet in the area near the ear, which can relieve the stethoscope effect and the head effect.

20 Claims, 4 Drawing Sheets

220

230

HORN ASSEMBLY AND DUAL-LISTENING BLUETOOTH HEADSET

CROSS REFERENCE OF RELATED APPLICATIONS

This present disclosure claims the priority and benefits of a Chinese patent application filed with the Chinese Patent Office, the application number is 201921859079.8, and the invention title is "horn assembly and dual-listening Bluetooth headset" on Oct. 31, 2019, the entire content of which is incorporated into this application by reference.

TECHNICAL FIELD

The present disclosure relates to a field of Bluetooth headsets, in particular to a horn assembly and a dual-listening Bluetooth headset.

BACKGROUND

The Bluetooth headsets on the market now basically produce sound from a single sound cavity. A single sound cavity directly faces the ear canal, which is directly inserted into the ear canal or half inserted into the ear canal. After the horn in the earphone emits the sound, the sound is directly transmitted forward along the ear canal. For people in some market segments, the insertion of earplugs into the ear canal makes the wearing experience less comfortable, and some people may even have tinnitus. In addition, the user need to tolerate the stethoscope effect of the way the sound propagates directly in the ear canal, which is likely to cause ear discomfort and head effect, which makes the hearing unnatural and lacks a sense of space.

SUMMARY

Therefore, it is necessary to provide a horn assembly and a dual-listening Bluetooth headset in response to the problem that the existing Bluetooth headset is not friendly to people in some market segments and has a stethoscope effect and a head effect during sound transmission.

The first aspect of the present disclosure provides a horn assembly, comprising a housing and a horn, wherein the housing is a hollow structure with a cavity inside, a mounting groove is arranged in the cavity, and a plurality of partitions are arranged in the cavity, a plurality of the partitions are connected end to end, the partitions and the housing are jointly enclosed to form the mounting groove, the mounting groove is a stepped groove and includes a mounting part and a sound emitting part, the width of the mounting part is greater than the width of the sound emitting part, thereby a stepped structure is formed between the mounting part and the sound emitting part, the horn is disposed on the mounting part and includes a sound emitting surface facing the sound emitting part, the housing is provided with a sound outlet corresponding to the sound emitting part, and the sound emitting part communicates with the outside world through the sound outlet.

The horn assembly, by setting the mounting groove in the cavity, the mounting part and the sound emitting part of the mounting groove form a stepped structure, and the horn is arranged in the mounting part, so that when the horn is installed on the mounting part, the sound emitting part is sealed, the sound emitting part is connected to the outside world only through the sound outlet. Since the sound emitting surface is set facing the sound emitting part, the horn does not emit sound in other directions. All the sounds from the sound emitting surface are transmitted into the sound emitting part, and then transmitted to the outside world through the sounding outlet. When the horn assembly is suspended in the area near the outer ear, on the one hand, the sound will not spread to the surroundings to avoid disturbing other persons. On the other hand, the sound emitted by the horn only travels in a single direction, which can enhance the penetration of the sound and make the ear easier to capture the sound.

The second aspect of the present disclosure provides a dual-listening Bluetooth headset, comprising a connecting cord, a Bluetooth component, a battery component, and a horn assembly; the connecting cord includes a first end and a second end that are arranged oppositely, and the Bluetooth component is arranged at the first end, the battery assembly is arranged at the second end, the horn assembly is provided with two, one of the horn assembly is arranged at the end of the Bluetooth assembly away from the connecting cord, and the other horn assembly is arranged at the end of the battery assembly away from the connecting cord; the horn assembly comprising a housing and a horn, wherein the housing is a hollow structure with a cavity inside, a mounting groove is arranged in the cavity, and a plurality of partitions are arranged in the cavity a plurality of the partitions are connected end to end, the partitions and the housing are jointly enclosed to form the mounting groove, the mounting groove is a stepped groove and includes a mounting part and a sound emitting part, the width of the mounting part is greater than the width of the sound emitting part, thereby a stepped structure is formed between the mounting part and the sound emitting part, the horn is disposed on the mounting part and includes a sound emitting surface facing the sound emitting part, the housing is provided with a sound outlet corresponding to the sound emitting part, and the sound emitting part communicates with the outside world through the sound outlet.

Since the dual-listening Bluetooth headset includes a horn assembly, the dual-listening Bluetooth headset also has the beneficial effects of the horn assembly.

DETAILED DESCRIPTION

Figure 1:
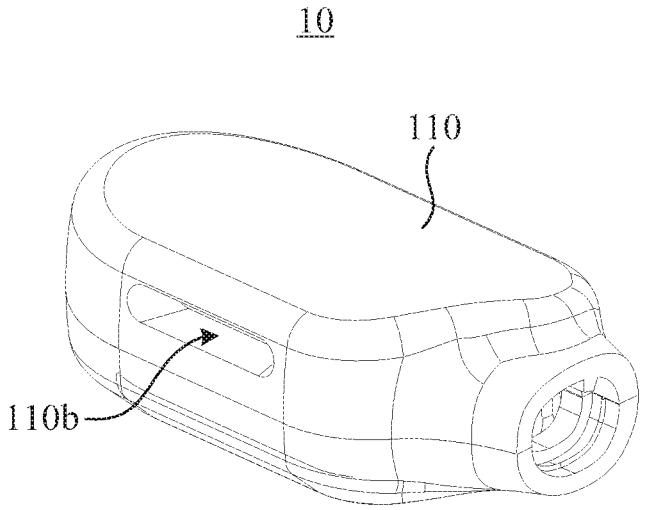
FIG. 1 is a schematic diagram of a horn assembly according to one embodiment of the present disclosure.

In order to facilitate the understanding of the present disclosure, the present disclosure will be described more fully below with reference to the relevant drawings. The preferred embodiments of the present disclosure are shown in the drawings. However, the present disclosure can be implemented in many different forms and is not limited to the embodiments described herein. On the contrary, the purpose of providing these embodiments is to make the present disclosure more thorough and comprehensive.

Unless otherwise defined, all technical and scientific terms used herein have the same meaning as commonly understood by those skilled in the technical field of the present disclosure. The terminology used in the description of the present disclosure herein is only for the purpose of describing specific embodiments, and is not intended to limit the present disclosure. The term "and/or" as used herein includes any and all combinations of one or more related listed items.

Unless otherwise defined, all technical and scientific terms used herein have the same meaning as commonly understood by those skilled in the technical field of the present disclosure. The terminology used in the description of the present disclosure herein is only for the purpose of describing specific embodiments, and is not intended to limit the present disclosure. The term "and/or" as used herein includes any and all combinations of one or more related listed items.

For the horn assembly and dual-listening Bluetooth headset of each embodiment of the present disclosure, when the dual-listening Bluetooth headset is worn, the sound outlet of the horn assembly does not need to be inserted into the ear canal, but only needs to be hung on the outer ear. It is more comfortable to wear and submit. The sound from the horn assembly is transmitted along the air through the sound outlet in the area near the ear, which can relieve the stethoscope effect and the head effect.

The horn assembly and dual-listening Bluetooth headset of each embodiment of the present disclosure will be described in detail below with reference to the drawings.

As shown in FIGS. 1-3 and FIG. 5, in one embodiment, the present disclosure provides a horn assembly 10. The horn assembly 10 comprises a housing 110 and a horn 120, the housing 110 is a hollow structure with a cavity 110*a* inside, a mounting groove 112 is arranged in the cavity 110*a*, the mounting groove 112 is a stepped groove and includes a mounting part 112*a* and a sound emitting part 112*b*, the width of the mounting part 112*a* is greater than the width of the sound emitting part 112*b*, thereby a stepped structure is formed between the mounting part 112*a* and the sound emitting part 112*b*, the horn 120 is disposed on the mounting part 112*a* and includes a sound emitting surface 121 facing the sound emitting part 112*b*, the housing 110 is provided with a sound outlet 110*b* corresponding to the sound emitting part 112*b*, and the sound emitting part 112*b* communicates with the outside world through the sound outlet 110*b*.

Figure 3:
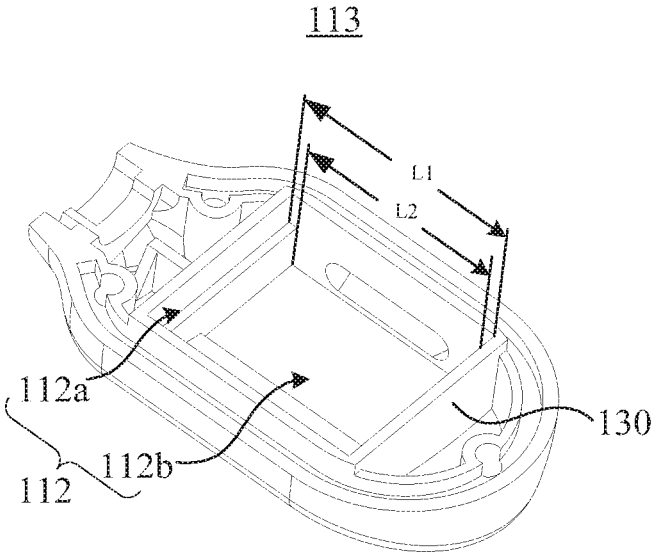
FIG. 3 is a schematic diagram of the structure of the lower housing of the horn assembly according to one embodiment of the present disclosure.
Figure 4:
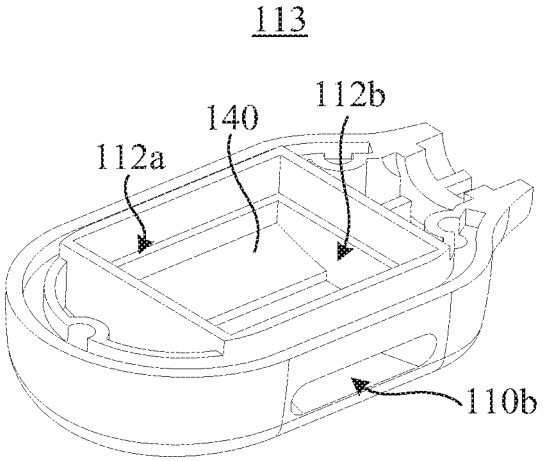
FIG. 4 is another structural diagram of the lower housing of the horn assembly according to one embodiment of the present disclosure.
Figure 5:
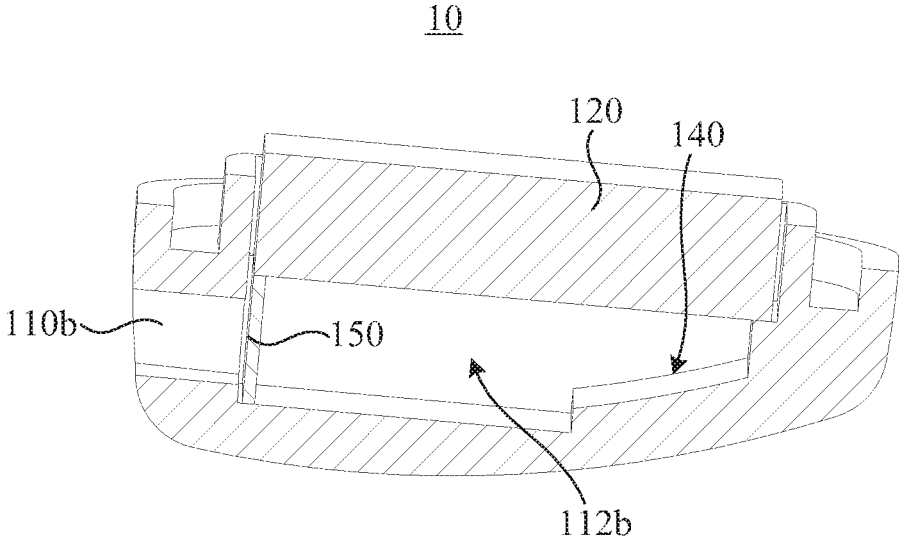
FIG. 5 is a schematic cross-sectional diagram of a horn assembly according to one embodiment of the present disclosure.

As shown in FIGS. 3-4, by providing the mounting groove 112 in the cavity 110*a*, a stepped structure is formed between the mounting part 112*a* and the sound emitting part 112*b* of the mounting groove 112, and the horn 120 is arranged in the mounting part 112*a*. Therefore, when the horn 120 is mounted on the mounting part 112*a*, the sound emitting part 112*b* is sealed and communicates with the outside world through the sound hole 110*b* only. Since the sound emitting surface 121 is disposed facing the sound emitting part 112*b*, the horn 120 does not emit sound in other directions, and all the sounds emitted by the sound emitting surface 121 are transmitted into the sound emitting part 112*b*, and then transmitted to the outside world through the sound outlet 110*b*. When the horn assembly 10 is suspended in the area near the outer ear, on the one hand, the sound will not spread to the surroundings to avoid disturbing other persons. On the other hand, the sound emitted by the horn 120 only travels in a single direction, which can enhance the penetration of the sound and make the ear easier to capture the sound.

Figure 2:
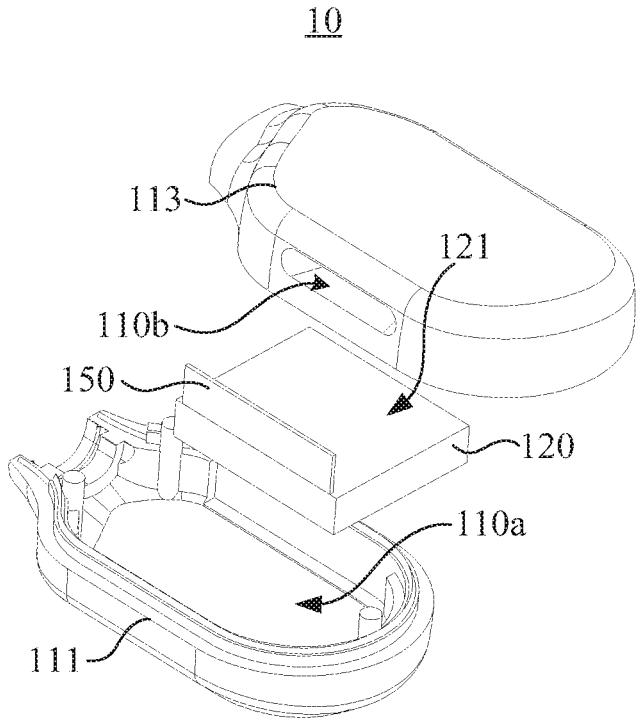
FIG. 2 is a schematic diagram of an exploded structure of a horn assembly according to one embodiment of the present disclosure.

As shown in FIG. 2, in one embodiment, the housing 110 may comprises an upper housing 111 and a lower housing 113, the upper housing 111 is fixedly connected to the lower housing 113, and the mounting groove 112 is provided on one of the upper housing 111 and the lower housing 113. For example, in the illustrated embodiment, the mounting groove 112 is provided on the lower housing 113. By providing the upper housing 111 and the lower housing 113, the installation of the horn 120 can be facilitated, and the subsequent maintenance is also facilitated. It can be understood that the upper housing 111 and the lower housing 113 may also be provided with mounting grooves 112. At this time, the horn 120 is partially accommodated in the mounting part 112*a* of the mounting groove 112 of the upper housing 111 and partially accommodated in the mounting part 112*a* of the mounting groove 112 of the lower housing 113, two corresponding sound emitting part 112*b* are also provided, and two sound outlet 110*b* may also be provided correspondingly.

As shown in FIGS. 3-4, in some embodiments, the bottom wall and/or the side wall of the mounting groove 112 may be a part of the housing 110, For example, in the illustrated embodiment, the bottom wall of the sound emitting part 112*b* is the inner side wall of the housing 110. Therefore, it is only necessary to provide a plurality of partitions 130 in the cavity 110*a*, and the plurality of partitions 130 are connected end to end, and the partitions 130 and the housing 110 are jointly enclosed to form the mounting groove 112, which can reduce the structural complexity of the horn assembly 10 and facilitate processing. Moreover, the volume of the cavity 110*a* can be used more effectively, which is beneficial to the miniaturization of the horn assembly 10. When the horn assembly 10 is applied to a Bluetooth headset, the appearance of Bluetooth headsets can be beautified.

In one or more embodiments, the sound outlet 110*b* is provided on the side wall of the sound emitting part 112*b*, so that the sound emitted by the sound emitting surface 121 does not directly propagate to the outside world through the sound outlet 110*b*. When the horn 120 works, the sound is emitted through the sound emitting surface 121. The sound first travels in a straight line and collides with the bottom wall of the sound emitting part 112*b* and returns to the sound emitting part 112*b*, and then propagates to the outside world through the sound outlet 110*b*. In the process, The sound is transmitted to the outside world after at least one collision, which can avoid the screaming sensation generated when the sound from the larger sound emitting surface 121 travels through the smaller sound outlet 110*b*. At the same time, it can also avoid the non-uniformity of sound transmission when the sound outlet 110*b* is sounding from the front. Since only part of the sound is transmitted at the first time, and most of the sound is transmitted after at least one collision. Therefore, The sound is transmitted to the outside world after at least one collision, which can improve the sound effect.

As shown in FIGS. 3-4, in some embodiments, in one or more embodiments, the sound emitting part 112*b* may also be provided with a reflecting wall 140. The bottom wall and the side wall of the sound emitting part 112*b* are connected by the reflecting wall 140. The plane where the reflecting wall 140 is located forms a preset angle with the plane where the sound emitting surface 121 is located, and the preset angle is not vertical. For example, in the illustrated embodiment, one reflective wall 140 is provided, and the reflective wall 140 and the sound outlet 110*b* are respectively provided on opposite sides of the sound emitting part 112*b*. It can be understood that, in other embodiments, the reflective wall 140 may also be provided with two, three or more. By providing the reflecting wall 140, the number of collisions of sound at the sound emitting part 112*b* can be reduced, the loss of sound can be reduced, and the sound effect can be improved.

As shown in FIG. 2, in some embodiments, the horn assembly 10 may further include a dust-proof net 150, which is arranged in the sound emitting part 112*b* and is arranged corresponding to the sound outlet 110*b*, and the sound outlet 110*b* is sealed by the dust-proof net.

For the horn assembly 10 above, by providing the mounting groove 112 in the cavity 110*a*, a stepped structure is formed between the mounting part 112*a* and the sound emitting part 112*b* of the mounting groove 112, and the horn 120 is arranged in the mounting part 112*a*. Therefore, when the horn 120 is mounted on the mounting part 112*a*, the sound emitting part 112*b* is sealed and communicates with the outside world through the sound hole 110*b* only. Since the sound emitting surface 121 is disposed facing the sound emitting part 112*b*, the horn 120 does not emit sound in other directions, and all the sounds emitted by the sound emitting surface 121 are transmitted into the sound emitting part 112*b*, and then transmitted to the outside world through the sound outlet 110*b*. When the horn assembly 10 is suspended in the area near the outer ear, on the one hand, the sound will not spread to the surroundings to avoid disturbing other persons. On the other hand, the sound emitted by the horn 120 only travels in a single direction, which can enhance the penetration of the sound and make the ear easier to capture the sound.

Figure 6:
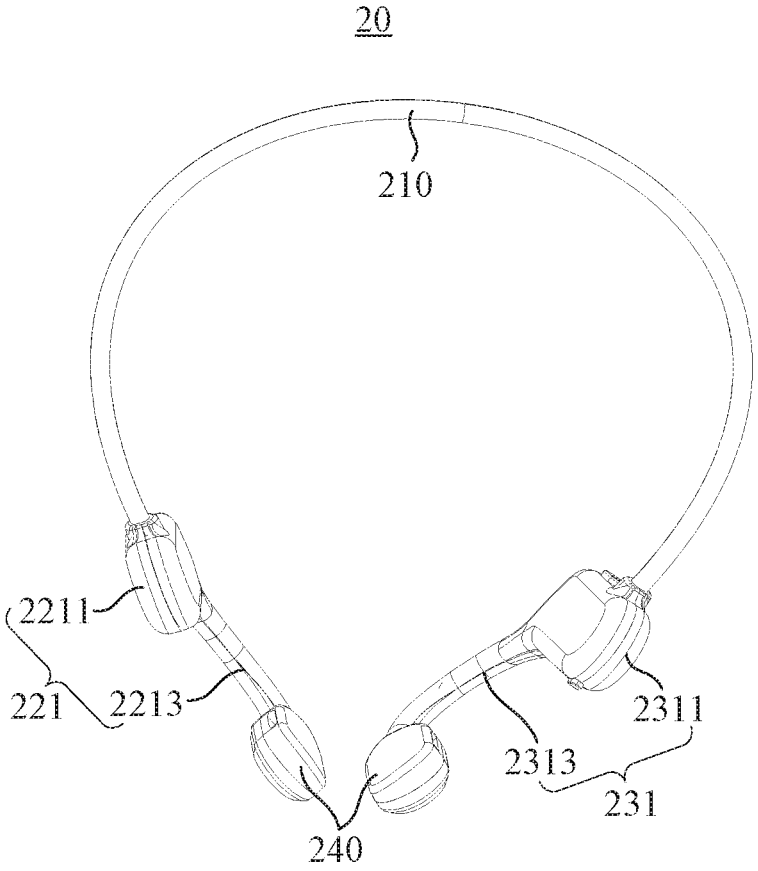
FIG. 6 is a schematic diagram of a dual-listening Bluetooth headset according to one embodiment of the present disclosure.
Figure 7:
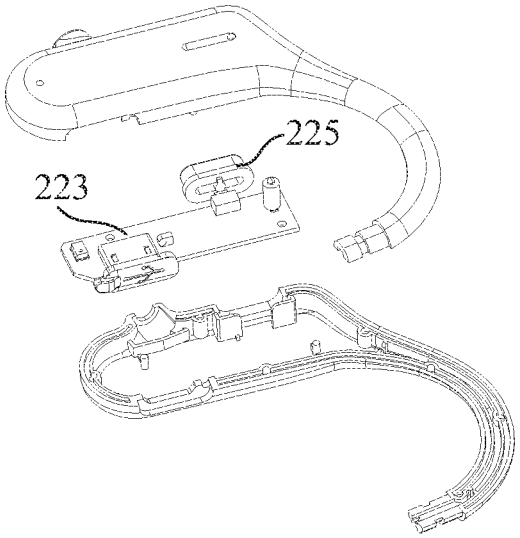
FIG. 7 is a schematic diagram of a Bluetooth component of a dual-listening Bluetooth headset according to one embodiment of the present disclosure.
Figure 8:
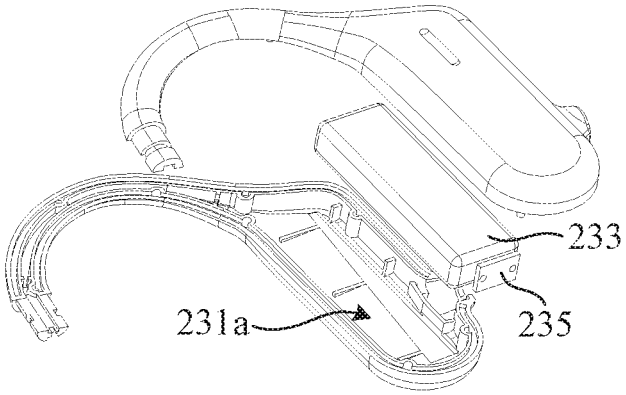
FIG. 8 is a schematic diagram of a battery assembly of a dual-listening Bluetooth headset according to one embodiment of the present disclosure.

As shown in FIGS. 6-8, in one embodiment, the present disclosure provides a dual-listening Bluetooth headset 20, comprising a connecting cord 210, a Bluetooth component 220, a battery component 230, and a horn assembly 240; the connecting cord 210 includes a first end and a second end that are arranged oppositely, and the Bluetooth component 220 is arranged at the first end, the battery assembly 230 is arranged at the second end, the horn assembly 40 is provided with two, one of the horn assembly 240 is arranged at the end of the Bluetooth assembly 220 away from the connecting cord 210, and the other horn assembly 240 is arranged at the end of the battery assembly 230 away from the connecting cord 210. And the horn assembly 240 is the horn assembly 10 described in any of the above embodiments.

The connecting cord 210 may be a memory wire rope, which can be deformed and return to its original shape after the deformation, so that the shape of the Bluetooth headset can be better maintained. At the same time, the setting of the connecting cord 210 allows the connecting cord 210 to be hung around the neck when the dual-listening Bluetooth headset 20 is used, which makes the dual-listening Bluetooth headset 20 can be better fixed and prevents the dual-listening Bluetooth headset 20 from falling.

As shown in FIG. 7 the Bluetooth component 220 comprises a Bluetooth housing 221 and a Bluetooth panel 223, the Bluetooth housing 221 is provided with a Bluetooth cavity 221*a*, the Bluetooth panel 223 is arranged in the Bluetooth cavity 221*a*, the Bluetooth panel 223 is provided with a Bluetooth module (not shown in the figure) and a Bluetooth circuit (not shown in the figure), the Bluetooth circuit and the Bluetooth module is used to implement Bluetooth receiving and transmitting functions.

The Bluetooth housing 221 may includes a first cavity portion 2211 and a first connection portion 2213, the first connection portion 2213 is fixedly connected to the first cavity portion 2211, the connecting cord 210 is fixedly connected to the first cavity portion 2211, and one of the horn assembly 240 is fixedly connected to the first connection portion 2213; the Bluetooth panel 223 is disposed in the first cavity portion 2211, a communication channel (not shown in the figure) is provided in the first connection portion 2213, the communication channel is used for wiring, and the horn assembly 240 is connected to the Bluetooth panel 223 through wiring.

In one or more embodiments, the first connection portion 2213 is bent into a preset arc, so that one of the horn assemblies 240 can be hung on the outer ear through the first connection portion 2213.

The Bluetooth component 220 further includes a Bluetooth switch 225 to control the work of the Bluetooth module. When the Bluetooth module works, audio is received by the Bluetooth module and transmitted to the horn assembly 240 for playing; when the Bluetooth switch 225 is switched off, the Bluetooth module stops working, that is, the Bluetooth module stops audio playback.

As shown in FIG. 8, the battery component 230 comprises a battery housing 231 and a battery 233. The battery housing 231 is provided with a battery compartment 231*a*, the battery 233 is arranged in the battery compartment 231*a*, and the battery 233 is electrically connected to the Bluetooth component 220 and the horn assembly 240 to supply power to the Bluetooth component 220 and the horn assembly 240.

The battery housing 231 may includes a second cavity portion 2311 and a second connection portion 2313, the second connection portion 2313 is fixedly connected to the second cavity portion 2311, the battery compartment 231*a* is disposed in the second cavity portion 2311, and the connecting cord 210 is fixedly connected to the second cavity portion 2311, and another horn assembly 240 is fixedly connected to the second connection portion 2313.

In one or more embodiments, the second connection portion 2313 is bent into a preset arc, so that another horn assembly 240 can be hung on the outer ear through the second connection portion 2313.

In one or more embodiments, the battery component 230 further includes a charging board 235 on which a charging circuit is provided, the battery 233 is connected to the charging circuit, the charging circuit is provided with a charging interface, and the battery 233 is a rechargeable battery. Therefore, the battery 233 can be charged through the charging board 235.

Since the dual-listening Bluetooth headset 20 includes the horn assembly 10, the dual-listening Bluetooth headset 20 also has the beneficial effects that the horn assembly 10 has.

When using the dual-listening Bluetooth headset 20, the dual-listening Bluetooth headset 20 is hung on the outer ear. At this time, the horn assembly 240 is suspended outside the external auditory canal through the Bluetooth component 220 and the battery component 230. The Bluetooth switch 225 is switched on, audio starts to be received by the Bluetooth module and amplified by the horn assembly 240, and the amplified sound is transmitted from the sound outlet to the area near the external auditory canal after the collision and reflection of the sound emitting part, and then propagated into the external auditory canal through the air, and is perceived by the user's auditory system. Because the dual-listening Bluetooth headset is not directly inserted into the external auditory canal, but transmitted through the air, the tinnitus phenomenon of using traditional in-ear headphones can be avoided. In addition, the earphones are transmitted through the air and then captured by the auditory system, similar to the sound that the ear directly captured from the natural environment, avoiding the amplified sound directly impacts the ear canal, which can avoid damage to the ear canal, and at the same time can avoid the stethoscope effect and the head effect.

The various technical features of the above-mentioned embodiments can be combined arbitrarily. In order to make the description concise, all possible combinations of the various technical features in the above-mentioned embodiments are not described. However, as long as there is no contradiction in the combination of these technical features, All should be considered as the scope of this specification.

The above-mentioned embodiments only express a few implementation modes of the present disclosure, and their description is relatively specific and detailed, but they should not be understood as a limitation on the scope of the patent disclosure. It should be pointed out that for those of ordinary skill in the art, without departing from the concept of this application, several modifications and improvements can be made, and these all fall within the protection scope of this application. Therefore, the scope of protection of the patent of this disclosure shall be subject to the appended claims.

What is claimed is:

1. A horn assembly, comprising a housing and a horn, wherein the housing is a hollow structure with a cavity inside, a mounting groove is arranged in the cavity, and a plurality of partitions are arranged in the cavity, a plurality of the partitions are connected end to end, the partitions and the housing are jointly enclosed to form the mounting groove, the mounting groove is a stepped groove and includes a mounting part and a sound emitting part, the width of the mounting part is greater than the width of the sound emitting part, thereby a stepped structure is formed between the mounting part and the sound emitting part, the horn is disposed on the mounting part and includes a sound emitting surface facing the sound emitting part, the housing is provided with a sound outlet corresponding to the sound emitting part, and the sound emitting part communicates with the outside world through the sound outlet.

2. The horn assembly according to claim 1, wherein the housing comprises an upper housing and a lower housing, the upper housing is fixedly connected to the lower housing, and the mounting groove is provided on one of the upper housing and the lower housing.

3. The horn assembly according to claim 1, wherein the sound outlet is arranged on the side wall of the sound emitting part, so that the sound emitted by the sound emitting surface is transmitted to the outside world after at least one collision.

4. The horn assembly according to claim 1, wherein a reflecting wall is provided in the sound emitting part, the bottom wall and the side wall of the sound emitting part are connected by the reflecting wall, and the plane where the reflecting wall is located forms a preset angle with the plane where the sound emitting surface is located, and the preset angle is not vertical.

5. The horn assembly according to claim 3, wherein a reflecting wall is provided in the sound emitting part, the bottom wall and the side wall of the sound emitting part are connected by the reflecting wall, and the plane where the reflecting wall is located forms a preset angle with the plane where the sound emitting surface is located, and the preset angle is not vertical.

6. The horn assembly according to claim 5, wherein the reflecting wall is provided with one, the reflecting wall and the sound outlet are respectively arranged on opposite sides of the sound emitting part.

7. The horn assembly according to claim 1, wherein the horn assembly further includes a dust-proof net, which is arranged in the sound emitting part and is arranged corresponding to the sound outlet, and the sound outlet is sealed by the dust-proof net.

8. A dual-listening Bluetooth headset, comprising a connecting cord, a Bluetooth component, a battery component, and a horn assembly; the connecting cord includes a first end and a second end that are arranged oppositely, and the Bluetooth component is arranged at the first end, the battery assembly is arranged at the second end, the horn assembly is provided with two, one of the horn assembly is arranged at the end of the Bluetooth assembly away from the connecting cord, and the other horn assembly is arranged at the end of the battery assembly away from the connecting cord; the horn assembly comprising a housing and a horn, wherein the housing is a hollow structure with a cavity inside, a mounting groove is arranged in the cavity, and a plurality of partitions are arranged in the cavity, a plurality of the partitions are connected end to end, the partitions and the housing are jointly enclosed to form the mounting groove, the mounting groove is a stepped groove and includes a mounting part and a sound emitting part, the width of the mounting part is greater than the width of the sound emitting part, thereby a stepped structure is formed between the mounting part and the sound emitting part, the horn is disposed on the mounting part and includes a sound emitting surface facing the sound emitting part, the housing is provided with a sound outlet corresponding to the sound emitting part, and the sound emitting part communicates with the outside world through the sound outlet.

9. The dual-listening Bluetooth headset according to claim 8, wherein the housing comprises an upper housing and a lower housing, the upper housing is fixedly connected to the lower housing, and the mounting groove is provided on one of the upper housing and the lower housing.

10. The dual-listening Bluetooth headset according to claim 8, wherein the sound outlet is arranged on the side wall of the sound emitting part, so that the sound emitted by the sound emitting surface is transmitted to the outside world after at least one collision.

11. The dual-listening Bluetooth headset according to claim 8, wherein a reflecting wall is provided in the sound emitting part, the bottom wall and the side wall of the sound emitting part are connected by the reflecting wall, and the plane where the reflecting wall is located forms a preset angle with the plane where the sound emitting surface is located, and the preset angle is not vertical.

12. The dual-listening Bluetooth headset according to claim 10, wherein a reflecting wall is provided in the sound emitting part, the bottom wall and the side wall of the sound emitting part are connected by the reflecting wall, and the plane where the reflecting wall is located forms a preset angle with the plane where the sound emitting surface is located, and the preset angle is not vertical.

13. The dual-listening Bluetooth headset according to claim 12, wherein the reflecting wall is provided with one, the reflecting wall and the sound outlet are respectively arranged on opposite sides of the sound emitting part.

14. The dual-listening Bluetooth headset according to claim 8, wherein the horn assembly further includes a dust-proof net, which is arranged in the sound emitting part and is arranged corresponding to the sound outlet, and the sound outlet is sealed by the dust-proof net.

15. The dual-listening Bluetooth headset according to claim 8, wherein the Bluetooth component comprises a Bluetooth housing and a Bluetooth panel, the Bluetooth housing is provided with a Bluetooth cavity, the Bluetooth panel is arranged in the Bluetooth cavity, the Bluetooth panel is provided with a Bluetooth module and a Bluetooth circuit, the Bluetooth circuit and the Bluetooth module is used to implement Bluetooth receiving and transmitting functions;

the Bluetooth housing includes a first cavity portion and a first connection portion, the first connection portion is fixedly connected to the first cavity portion, the Bluetooth panel is disposed in the first cavity portion, a communication channel is provided in the first connecting portion, the communication channel is used for wiring, and the horn assembly is connected to the Bluetooth panel through wiring;

the first connecting portion is bent into a preset arc so as to hang the horn assembly on the outer ear through the first connecting portion.

16. The dual-listening Bluetooth headset according to claim 8, wherein the battery component comprises a battery housing and a battery, the battery housing is provided with a battery compartment, the battery is arranged in the battery compartment, and the battery is electrically connected to the Bluetooth component and the horn component to supply power to the Bluetooth component and the horn assembly;

the battery housing includes a second cavity portion and a second connection portion, the second connection portion is fixedly connected to the second cavity portion, the battery compartment is disposed in the second cavity portion, and the connecting cord is fixedly connected to the second cavity portion, and the horn assembly is fixedly connected to the second connection portion;

the second connecting portion is bent into a preset arc so as to hang the horn assembly on the outer ear through the second connecting portion.

17. The dual-listening Bluetooth headset according to claim 11, wherein the Bluetooth component comprises a Bluetooth housing and a Bluetooth panel, the Bluetooth housing is provided with a Bluetooth cavity, the Bluetooth panel is arranged in the Bluetooth cavity, the Bluetooth panel is provided with a Bluetooth module and a Bluetooth circuit, the Bluetooth circuit and the Bluetooth module is used to implement Bluetooth receiving and transmitting functions;

the Bluetooth housing includes a first cavity portion and a first connection portion, the first connection portion is fixedly connected to the first cavity portion, the Bluetooth panel is disposed in the first cavity portion, a communication channel is provided in the first connecting portion, the communication channel is used for wiring, and the horn assembly is connected to the Bluetooth panel through wiring;

the first connecting portion is bent into a preset arc so as to hang the horn assembly on the outer ear through the first connecting portion.

18. The dual-listening Bluetooth headset according to claim 11, wherein the battery component comprises a battery housing and a battery, the battery housing is provided with a battery compartment, the battery is arranged in the battery compartment, and the battery is electrically connected to the Bluetooth component and the horn component to supply power to the Bluetooth component and the horn assembly;

the battery housing includes a second cavity portion and a second connection portion, the second connection portion is fixedly connected to the second cavity portion, the battery compartment is disposed in the second cavity portion, and the connecting cord is fixedly connected to the second cavity portion, and the horn assembly is fixedly connected to the second connection portion;

the second connecting portion is bent into a preset arc so as to hang the horn assembly on the outer ear through the second connecting portion.

19. The dual-listening Bluetooth headset according to claim 12, wherein the Bluetooth component comprises a Bluetooth housing and a Bluetooth panel, the Bluetooth housing is provided with a Bluetooth cavity, the Bluetooth panel is arranged in the Bluetooth cavity, the Bluetooth panel is provided with a Bluetooth module and a Bluetooth circuit, the Bluetooth circuit and the Bluetooth module is used to implement Bluetooth receiving and transmitting functions;

the Bluetooth housing includes a first cavity portion and a first connection portion, the first connection portion is fixedly connected to the first cavity portion, the Bluetooth panel is disposed in the first cavity portion, a communication channel is provided in the first connecting portion, the communication channel is used for wiring, and the horn assembly is connected to the Bluetooth panel through wiring;

the first connecting portion is bent into a preset arc so as to hang the horn assembly on the outer ear through the first connecting portion.

20. The dual-listening Bluetooth headset according to claim 12, wherein the battery component comprises a battery housing and a battery, the battery housing is provided with a battery compartment, the battery is arranged in the battery compartment, and the battery is electrically connected to the Bluetooth component and the horn component to supply power to the Bluetooth component and the horn assembly;

the battery housing includes a second cavity portion and a second connection portion, the second connection portion is fixedly connected to the second cavity portion, the battery compartment is disposed in the second cavity portion, and the connecting cord is fixedly connected to the second cavity portion, and the horn assembly is fixedly connected to the second connection portion;

the second connecting portion is bent into a preset arc so as to hang the horn assembly on the outer ear through the second connecting portion.

* * * * *